United States Patent [19]

Charbonneau et al.

[11] 4,128,984

[45] Dec. 12, 1978

[54] METHOD OF CONSTRUCTING A SLOPED ROOF

[75] Inventors: Robert R. Charbonneau, Lake Elmo; Robert M. Spatafore, St. Paul, both of Minn.

[73] Assignee: Minnesota Mining and Manufacturing Company, St. Paul, Minn.

[21] Appl. No.: 870,274

[22] Filed: Jan. 18, 1978

[51] Int. Cl.[2] ..... E04D 3/24

[52] U.S. Cl. ..... 52/746; 52/173 R; 52/478; 52/537

[58] Field of Search ..... 52/309.3, 309.4, 309.5, 52/309.6, 418, 419, 420, 746, 748, 173, 537, 478, 631, 520, 543

[56] References Cited

U.S. PATENT DOCUMENTS

| | | | |
|---|---|---|---|
| 3,239,478 | 3/1966 | Harlan | 260/27 |
| 3,265,756 | 8/1966 | Holden et al. | 260/876 |
| 3,565,247 | 2/1971 | Brochman | 206/59 |
| 3,991,002 | 11/1976 | Sadlo | 260/32.8 A |
| 4,014,148 | 3/1977 | Harter | 52/537 |

FOREIGN PATENT DOCUMENTS 747341 11/1966 Canada.

*Primary Examiner*—John E. Murtagh
*Attorney, Agent, or Firm*—Cruzan Alexander; Donald M. Sell; Robert E. Granrud

[57] ABSTRACT

After priming the purlins of a post frame building with a blend of rubbery block copolymer and compatible tackifier resin, double-coated foam-backed pressure-sensitive adhesive tape is applied to the primed surfaces to secure the roof panels, which pressure-sensitive adhesive comprises rubbery block copolymer and compatible tackifier resin.

5 Claims, 2 Drawing Figures

METHOD OF CONSTRUCTING A SLOPED ROOF

BACKGROUND OF THE INVENTION

Figure 1:
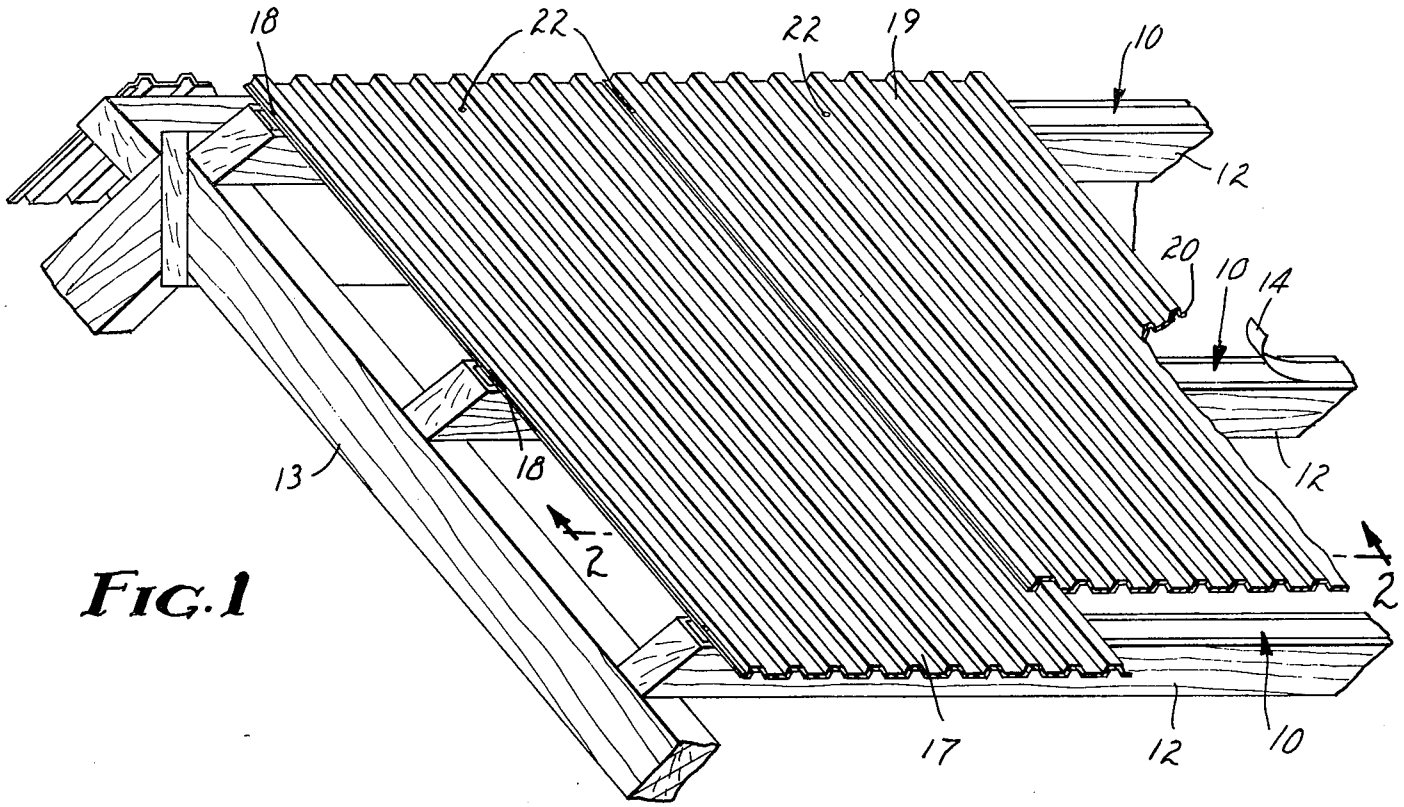

Post frame buildings, also sometimes called "pole barns", can be erected quickly, typically within two working days, and yet are sturdy and long-lasting. Such buildings have virtually superseded other types of farm buildings in new construction during the past twenty years or so, at least where building codes have not dictated otherwise.

A post frame building has a sloped roof comprising panels laid on purlins. Generally, nails secure the roof panels to the purlins. Because rain may leak through the nail holes in the roof panels, the roof panels have been secured to the purlins with a structural adhesive. The adhesives which have been used employ a volatile vehicle which must partially evaporate before a strong bond can be made but still retain some of the vehicle when the panels are laid in place. This has required the purlins to be in place before the adhesive is applied, and its application at that time can be awkward and dangerous. Such an adhesive does not provide an immediate bond of sufficient strength to resist localized lifting forces due to irregularities in the surfaces of both the purlins and the panels plus whatever additional lifting forces are exerted by the prevailing wind. Hence, pressure-sensitize adhesive tape has been used side-by-side with the structural adhesive.

OTHER PRIOR ART

The present invention makes use of known adhesive materials, e.g., the adhesive primer composition of U.S. Pat. No. 3,991,002 (Sadlo) and a double-coated foam-backed pressure-sensitive adhesive tape construction of the type disclosed in Canadian Pat. No. 747,341. A suitable pressure-sensitive adhesive composition for such a foam-backed tape construction is disclosed in U.S. Pat. No. 3,239,478 (Harlan).

THE INVENTION

The present invention makes it practical to adhesively secure the roof panels to the purlins of a post frame building. In a preferred construction, some nails are used in fastening the roof panels to wood purlins or screws to metal purlins, but only in unexposed areas, because there should be no holes through which rain may leak.

The novel method comprises the steps of (a) priming the surfaces of the purlins to be contacted by the roof panels with an adhesion-promoting primer composition which is dissolved or dispersed in a volatile vehicle, (b) allowing the vehicle to volatilize, (c) applying onto the primed surfaces a double-coated foam-backed pressure-sensitive adhesive tape having a disposable low-adhesion web protecting the tape from contamination, (d) after the purlins are positioned in the building, peeling away the low-adhesion web to expose the pressure-sensitive adhesive tape, and (e) laying the roof panels against the exposed pressure-sensitive adhesive tape.

The term "double-coated foam-backed pressure-sensitive adhesive tape" is used to encompass both a tape having a central foam and a pair of pressure-sensitive adhesive coatings on its faces and a tape having the same attributes, e.g., a tape having a single pressure-sensitive adhesive layer which is a foam as in U.S. Pat. No. 3,565,247 (Brochman) or acts like a foam.

The primer composition used in step (a) may be that of U.S. Pat. No. 3,991,002, the disclosure of which is incorporated herein by reference. That primer composition comprises a blend of rubbery block copolymer of elastomeric and plastic polymer blocks and compatible tackifier resins, namely a conjugated-diene-compatible resin and a polystyrene-compatible resin. The ratio of the rubbery copolymer to the tackifier resins preferably is from 15:85 to 35:65 as taught in the patent. For long life, the primer should include an antioxidant such as listed in U.S. Pat. No. 3,991,002.

To allow for irregularities in the surfaces being joined by the adhesive tape, its foam backing should be resilient and have a thickness of at least 1/32 inch. Foam thicknesses greater than ¼ inch would be economically wasteful. In order to withstand forces to which it may be exposed in use, the foam backing should have a tensile strength of at least 50 pounds per square inch and an elongation of at least 100%. Polyethylene foam meets these requirements and is significantly lower in cost than are other equally useful foams such as polyurethane and polychloroprene foams.

For the pressure-sensitive adhesive coatings of the tape, a composition similar to the primer compositions of U.S. Pat. No. 3,991,002 may be used, but preferably at a ratio of rubbery block copolymer to compatible tackifier resins of 35:65 to 65:35. Furthermore, it is preferred that the conjugated-diene-compatible resin of U.S. Pat. No. 3,991,001 be wholly or partially replaced by a hydrocarbon extender oil of the type disclosed in U.S. Pat. No. 3,239,478 (Harlan) in order to enhance the immediate bonding capability ("wet grab") of the adhesive. In employing an extender oil, care should be taken not to employ such large amounts as would make the adhesive coatings significantly less cohesive than adhesive, generally no greater than 20 parts per 100 parts by weight of rubbery block copolymer. Because the cost of extender oils is currently about 10% of the least expensive rubbery block copolymers, there is a commercial advantage in using as much oil as possible.

Preferably the rubbery block copolymer of the pressure-sensitive adhesive composition is a mixture, the major proportion of which has an average molecular weight exceeding 200,000 in order to provide high cohesive strength. Such a rubbery block copolymer is disclosed in U.S. Pat. No. 3,265,765 (Holden et al.). A minor proportion has an average molecular weight not exceeding 100,000 in order to improve the immediate bonding capability without degrading the high cohesive strength and the ability to form strong bonds to surfaces which are moderately contaminated by the oils generally present on metal roof panels or by the wood dust and pitch at the surfaces of wooden purlins. In any event, the pressure-sensitive adhesive coatings should tend to form immediate bonds that can withstand a force of 25 psi in tension for at least 24 hours at 70° F.

The pressure-sensitive adhesive coatings should contain an antioxidant such as listed in U.S. Pat. No. 3,991,002 to provide long life.

In carrying out the method of the invention, the above-listed steps (a) through (c) are conveniently carried out on the ground, and steps (d) and (e) are performed after the purlins are in place on the building. The low-adhesion protective webs may be peeled back in stepwise fashion to expose only those portions of the foam-backed tape that will be contacted by one roof panel. However, because the pressure-sensitive adhesive coatings are inherently more cohesive than adhesive, they are not significantly affected if the workers step on the exposed adhesive surfaces, assuming their boots are reasonably clean.

Typically, the purlins are wood "2 × 4's" and hence about 1⅝ inches in width. By employing foam-backed tape one inch in width centered on the purlins, adequate bond strength to corrugated metal or other roof panels should be attained to resist the lifting force of a strong wind, even on a very hot day. However, it is generally desirable that the adhesive bonds fail at some of the panels if the wind has such force that the building might be destroyed unless some of the stress on the building is relieved.

THE DRAWING

Figure 2:
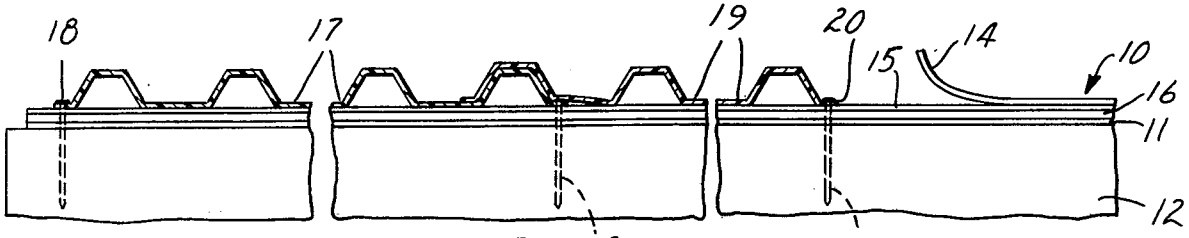

In the drawing:

FIG. 1 shows in schematic perspective a portion of the roof of a typical post frame building embodying the invention and FIG. 2 is an enlarged cross-section along line 2 — 2 of FIG. 1.

Double-coated foam-backed pressure-sensitive adhesive tape 10 is adhered by one of its adhesive coatings 11 (seen only in FIG. 2) to the upper surfaces of the purlins 12 which already have a primer coating (not shown). Then the purlins are nailed to rafters 13. The foam layer 16 of the tape 10 is compressible to allow for irregularities in the surfaces being joined by the tape.

After the low-adhesive web 14 of the tape has been peeled away to expose the outer adhesive coating 15, the first roof panel 17 is laid in place and may be nailed along both edges as indicated at 18 since the nails at its outer edge will be covered by a fascia and the nails at its inner edge will be covered by a second panel 19. The panel 19 in turn is nailed at 21 along its other edge 20. If desired, a double-coated foam-backed pressure-sensitive adhesive tape (not shown) may be applied to the upper surface of the inner edge of the first panel 17 to provide a seal to the overlapping edge of the second panel 19.

Because the crown of the roof is to be covered by a ridge cap (not shown), the roof panels 17 and 19 may also be nailed at 22. Thus the second panel 19 and subsequent roof panels are mechanically fastened along two edges and may also be nailed along the third edge at the eaves (not shown) because leakage is usually permissible through the eaves. The fourth edge of the panel 19 and its broad underface are secured to the purlins only by the pressure-sensitive adhesive tapes.

In the following example, all parts are given by weight.

EXAMPLE

A preferred pressure-sensitive adhesive composition is prepared by dissolving the following ingredients in toluene to yield a 45% solids solution.

| | Parts |
|---|---|
| Rubbery block copolymer of 70 parts butadiene and 30 parts styrene, average molecular weight exceeding 200,000 | 100.0 |
| Rubbery block copolymer of 75 parts butadiene and 25 parts styrene, average molecular weight of 50,000 - 100,000 | 51.6 |
| Polystyrene-compatible tackifier resin | 151.6 |
| Hydrocarbon extender oil | 16.1 |

-continued

| | Parts |
|---|---|
| Antioxidant | 3.2 |

This solution is spread onto a silicone-treated paper web using a knife coater and dried at a temperature of about 200° F. After solvent evaporation and cooling, the coating weight should be about 13 grains of adhesive per 24 square inches. The coated paper web is laminated immediately upon exiting the drying oven to a cross-linked polyethylene copolymer foam of essentially closed cell form having density of about 6 pounds per cubic foot ("Voltek" Type E). The same solution is later knife-coated onto the exposed surface of the polyethylene foam to provide a second pressure-sensitive adhesive coating of approximately the same coating weight. The resultant foam-backed pressure-sensitive adhesive tape is wound upon itself into a roll form for convenience of storage, shipment and use.

Wooden purlins to be used in a post frame farm building are coated, using a paint roller, with a dilute solution (33% solids) of the primer composition of claim 7 of U.S. Pat. No. 3,991,002. After drying the primer under ambient conditions for at least 10 minutes, but not more than one day, the foam-backed tape is unwound to expose an adhesive coating which is laid centrally onto each primed purlin surface. After the purlins are nailed into place, the protective paper web may be removed from the tape to expose the other adhesive coating. The roof membranes are positioned and pressed against the exposed adhesive. Nails or screws may be used as shown in FIG. 1 of the drawing.

The roof panels often possess a natural bow which exerts a small continuous force which will cause the adhesive to fail if it does not provide long-term load-holding qualities. A test which evaluates this quality has been devised in which a one-inch tape specimen is bonded without any nails to an aluminum plate and to a section of construction grade lumber which has previously been primed as disclosed in U.S. Pat. No. 3,991,002. A force of 25 pounds is applied normal to the bond line at 70° F. immediately after the bond is made. The adhesive of several test specimens failed under this load at 30 to 500 hours.

Test specimens prepared as above and immediately cooled to −20° F. for testing exhibited an average load-to-failure value of 135 pounds per square inch. When instead immediately heated to 120° F. and tested, the average load-to-failure value was 55 pounds per square inch.

A large sheet of corrugated aluminum ("Alcoa Temper Rib") was bonded without any nails to primed 2 × 4 inches wood purlins on 24 inch centers as described above. The face of the aluminum sheet opposite to the purlins was sealed to a box from which air was then withdrawn. At 70° F., the bonds failed between the adhesive and the aluminum under a load of 57.2 pounds per square foot (16.3 pounds per square inch of bonded area). The load-to-failure to this simulated roof section is about 2½ times the load imposed by an 80–90 mph wind on a typical post frame structure.

When used to secure aluminum roof panels to steel purlins, the pressure-sensitive adhesive tape employed in the practice of the invention offers the added advantage of providing a spacing, thus obviating possible electrolytic action. It also should reduce noise.

We claim:

1. In constructing a building having a sloped roof comprising panels laid on purlins, the method of securing the panels to the purlins comprising the steps of:

(a) priming the surfaces of the purlins to be contacted by the roof panels with an organic solvent solution or stable dispersion of rubbery block copolymer of elastomeric and thermoplastic polymer blocks and compatible tackifier resin, (b) allowing the solvent to volatilize, (c) applying onto the primed surfaces a double-coated foam-backed pressure-sensitive adhesive tape, the foam backing of which has a thickness of 1/32 to ¼ inch, a tensile strength of at least 50 pounds per square inch and an elongation of at least 100%, the pressure-sensitive adhesive of the tape comprising rubbery block copolymer of elastomeric and thermoplastic polymer blocks and compatible tackifier resin and having a disposable low-adhesion web protecting the outer surface of the tape, (d) after the purlins are positioned in the building, peeling away the low-adhesion web and, (e) laying the roof panels against the exposed surface of the pressure-sensitive adhesive tape.

2. Method as defined in claim 1 wherein the purlins are wood and the roof panels are corrugated metal sheets.

3. Method as defined in claim 2 wherein the foam backing of the adhesive tape is polyethylene.

4. Method as defined in claim 3 wherein the rubbery block copolymer of each pressure-sensitive adhesive coating is a mixture, the major proportion of which has an average molecular weight exceeding 200,000 and a minor proportion of which has an average molecular weight not exceeding 100,000.

5. Method as defined in claim 4 wherein the compatible tackifier resin of each pressure-sensitive adhesive coating is styrene-compatible and a hydrocarbon extender oil is present in an amount up to 20 parts per 100 parts by weight of its rubbery block copolymer.

* * * * *